US005319997A

United States Patent [19]

Galloway et al.

[11] Patent Number: 5,319,997

[45] Date of Patent: Jun. 14, 1994

[54] AUTOMATIC RATCHET BLOCK

[76] Inventors: Peter Galloway, 26 Friendlee La., Wilton, Conn. 06897; Peter L. Wilson, 722 Silvermine Rd., New Canaan, Conn. 06840

[21] Appl. No.: 905,725

[22] Filed: Jun. 29, 1992

[51] Int. Cl.[5] ..... G05G 1/00; B66D 1/14

[52] U.S. Cl. ..... 74/577 S; 192/46; 254/352; 254/266; 74/575; 74/577 R; 74/505; 74/506

[58] Field of Search ..... 192/45, 47; 254/353, 254/352, 266, 306; 74/575, 577 R, 577 S, 577 SF, 578, 504, 505, 506, 507, 543

[56] References Cited

U.S. PATENT DOCUMENTS

| | | | |
|---|---|---|---|
| 632,910 | 9/1899 | Wiley | 254/353 |
| 2,184,149 | 12/1939 | Marr | 74/505 X |
| 2,633,953 | 4/1953 | Gorske | 192/47 |
| 2,690,240 | 9/1954 | Schroeder | 74/505 X |
| 2,718,949 | 9/1955 | Taylor | 192/47 |
| 3,421,605 | 1/1969 | Hansen | 192/46 X |
| 3,606,940 | 9/1971 | Finkeldei | 192/46 X |
| 4,028,954 | 6/1977 | Mehnert | 192/46 X |
| 4,093,185 | 6/1978 | Newell | 74/505 X |
| 4,130,271 | 12/1978 | Merriman | 192/46 X |
| 4,685,632 | 8/1987 | Yeh | 74/577 S |
| 4,702,486 | 10/1987 | Tsuchie | 192/46 X |

FOREIGN PATENT DOCUMENTS

| | | | |
|---|---|---|---|
| 1029727 | 6/1953 | France | 74/577 S |
| 36518 | 9/1935 | Netherlands | 192/46 |
| 165169 | 6/1921 | United Kingdom | 192/46 |

*Primary Examiner*—Vinh T. Luong
*Attorney, Agent, or Firm*—Haynes N. Johnson

[57] ABSTRACT

A ratchet block comprised of a frame, moveable sheave assembly, ratchet assembly and cam wherein the ratchet automatically engages under load permitting rotation of the sheave in only one direction, and disengages when the load is removed permitting rotation in both directions. This automatic engagement and disengagement of the ratchet to increase or reduce friction when a rope or wire is run through the sheave does not require the user to disengage the ratchet mechanism with a conventional switch.

9 Claims, 3 Drawing Sheets

AUTOMATIC RATCHET BLOCK

Field of the Invention

The present invention relates to an improvement over conventional ratchet blocks, especially suitable for use on sail boats, but applicable to any filed where ratchet blocks are used.

Description of the Prior Art

Ratchet blocks typically consist of a sheave rotatably mounted on a shaft between two side plates and a ratchet assembly inside the sheave to allow rotation in one direction only when engaged, and in both directions when disengaged. Typically a ratchet arm is engaged with teeth on the inside of the sheave (or disengaged) by a mechanical switch, which can be thrown only when there is little or no pressure/load on the sheave. Thus if the user wants to shift the block from a ratcheting mode to a freewheeling mode (rotate in either direction) for reduced friction or from the freewheeling to ratcheting mode to increase, one must physically move to reach the switch with a hand, and concurrently remove the load from any line or wire that is running through the block. In many instances it is not possible to do either, so there is significant friction when the line or wire is eased out through the block as the sheave will not rotate in the direction of easing, or the benefit of ratcheting cannot be attained.

In sailboat racing, where the use of conventional ratchet blocks is widespread, the high friction caused by a ratchet-engaged non-rotating sheave helps reduce the effort required to pull a line through a block under load. However, this friction; 1) reduces the speed by which sailors can execute sail changes such as taking down the spinnaker; 2) encumbers rapid easing of a line attached to a sail; and 3) slows down sail adjustment required for rapid alteration of course and tacking/jibing. The advantage of friction caused by engaging the ratchet when trimming sails, is a disadvantage when easing them.

Further, because conventional ratchet blocks require manual switching to change from the ratchet-engaged to freewheeling mode and vice versa, they can only be located where they can be easily reached. On sailboats, this precludes their use high on the mast for halyards, or in other areas where the crew can't normally reach while sailing. It is therefore an objective of the present invention to automatically provide load dependent ratchet action for increased friction and freewheeling for significantly reduced friction, without the manual switching of conventional ratchet blocks. It is also an objective to expand the number of locations for using a ratchet block beyond those normally within easy reach. Further, it is object of the present invention to provide such a device which is easy and inexpensive to manufacture.

SUMMARY OF THE INVENTION

The present invention relates to a ratchet block assembly comprising:

a) a frame with two walls joined at at least one end having a fixed axis between the walls serving as the shaft for a moveable sheave assembly;

b) a moveable sheave assembly inside the frame comprising two side plates and a freely rotating sheave having teeth around the interior for engagement of a ratchet assembly, with the sheave having means to rotate in at least two different positions about the shaft; and c) a ratchet assembly comprising a cam having means to move about the shaft, an articulated ratchet arm, and means to concurrently engage the ratchet arm with the sheavers teeth and to provide contact between the cam and said ratchet arm.

The sheave rotates freely in either direction when no load is placed upon it, and when a load is placed on the sheave, the sheave assembly moves towards the cam and causes the ratchet arm to engage the sheavers teeth thereby permitting rotation in only one direction. This engagement of the ratchet arm is automatic and does not require a conventional switch. The sheave assembly has means to move away from the cam when the load is removed and thereby automatically disengaging the ratchet arm from sheave's teeth allowing free rotation in either direction. This automatic disengagement of the ratchet arm which allows the sheave to rotate freely in either direction, significantly reduces friction when a rope or wire is run through the sheaves, and thus does not require the user to disengage the ratchet mechanism with a conventional switch.

In a particularly preferred embodiment, the present invention comprises a bearing block with a moveable sheave assembly and a ratchet assembly activated by the sheave's position relative to a cam. The sheave assembly has an oval shaft aperture slightly larger than the diameter of the shaft fixed to the block frame, enabling it to rotate in two different positions, one at each end of the shaft aperture. When loaded (pressure generated by tension on the line or wire passing through the block), the sheave assembly is pulled towards the general direction of the load, forcing an articulated ratchet arm against a cam such that it engages teeth on the inside of the sheave. The teeth engaging end of the ratchet arm prevents rotation in one direction but allows it in the other. When the load is released, a compression spring at one end of the frame pulls the sheave assembly away from the direction of the released load. In this position, the pressure of the cam no longer forces the ratchet arm to engage, and a coil spring pulls the arm away from the sheave teeth, allowing the sheave to rotate freely in either direction (free wheel).

This automatic disengagement of the ratchet arm will occur when the user releases the line or wire running through the block because it will remove the load pressure on the sheave, and the compression spring will move the sheave assembly back to its original position. Instead of staying in the ratchet mode (preventing rotation in one direction), the sheave will freewheel and allow the line to run out through the block with little or no friction. Thus someone on a sailboat, in this case, can cast off (let go) a sheet or halyard and have it run out much faster. This will speed up sail changes and maneuvers that require dramatic change in sail trim.

The ratchet block has a manual switch that allows the user to put in the "automatic" mode, where only a load will engage the ratchet arm, in the "on" mode, where the ratchet is always engaged, and the off mode where the block freewheels in both directions whether or not there is a load on the sheave.

BRIEF DESCRIPTION OF THE DRAWINGS

While the specification concludes with claims particularly pointing out and distinctly claiming the present invention, it is believed that the present invention will be better understood from the following description in conjunction with the accompanying drawings in which:

DESCRIPTION OF THE PREFERRED EMBODIMENT

Although it is recognized that other configurations are possible, the drawings represent one specific embodiment of the invention. However, advantageous use of the self releasing ratchet block is in no way limited to sailing. The devices of the present invention may be used for any purpose where automatic engagement and disengagement of a ratchet mechanism is necessary or desirable.

Figure 1:
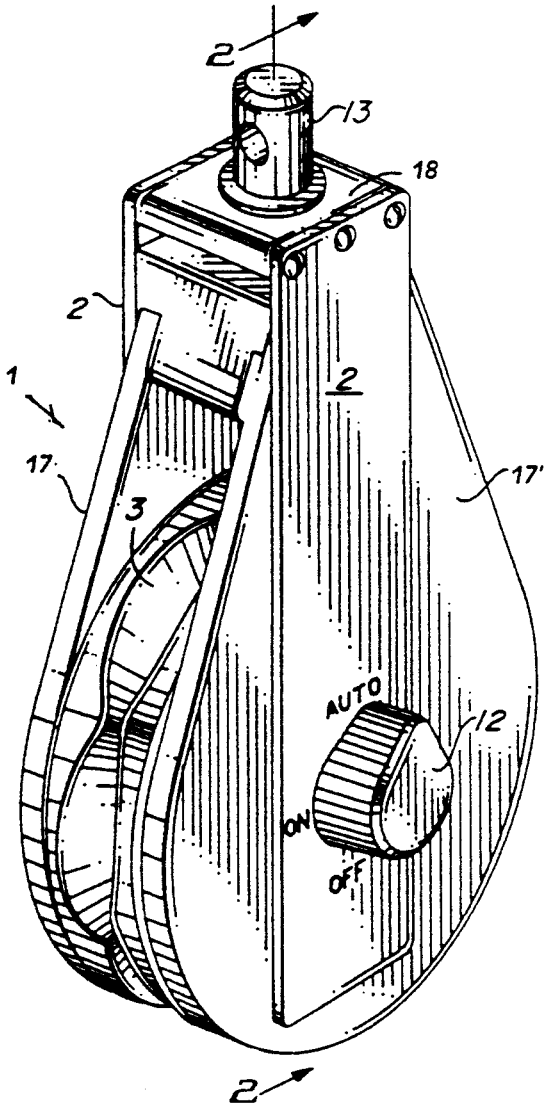
FIG. 1 shows an external view of the ratchet block.

FIG. 1 shows an external view of the ratchet block fully assembled. The sheave (3) is held between the side plates 17 and 17" of the sheave assembly (1), which is held in place by the frame (2). A switch (12) on each side of the block enables the user to put the block in three modes, automatic ratching (auto), always ratcheting (on), and always freewheeling (off).

Figure 2:
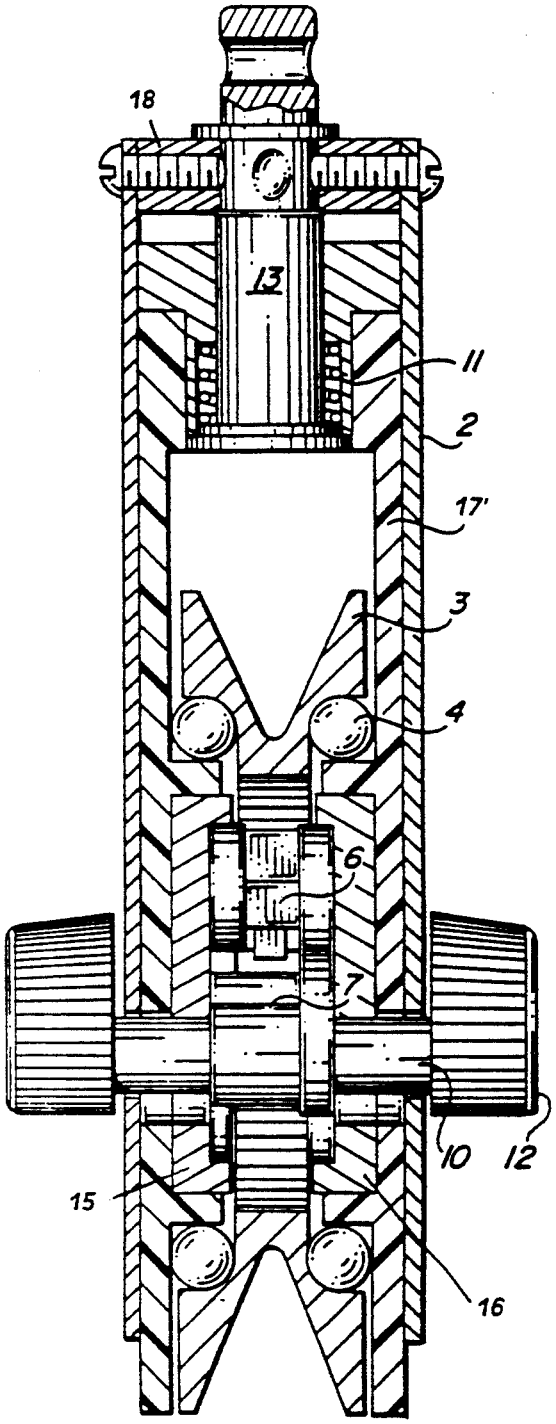
FIG. 2 is a transverse vertical section of the ratchet block.

FIG. 2 is a transverse section of the ratchet block. The sheave (3) with ball bearings (4) between the side plates of the sheave assembly (1), which is held in place by the frame (2) composed of side plates 17 and 17" plate 18 and a centerpost (13). The cam (7) fixed upon the shaft (10) engages the ratchet arm (6) when a load is placed on the sheave (3) thereby moving the sheave (3) and sheave assembly (1) away from the end of the frame (2) and compressing the compression spring (11) about the centerpost (13).

Figure 3:
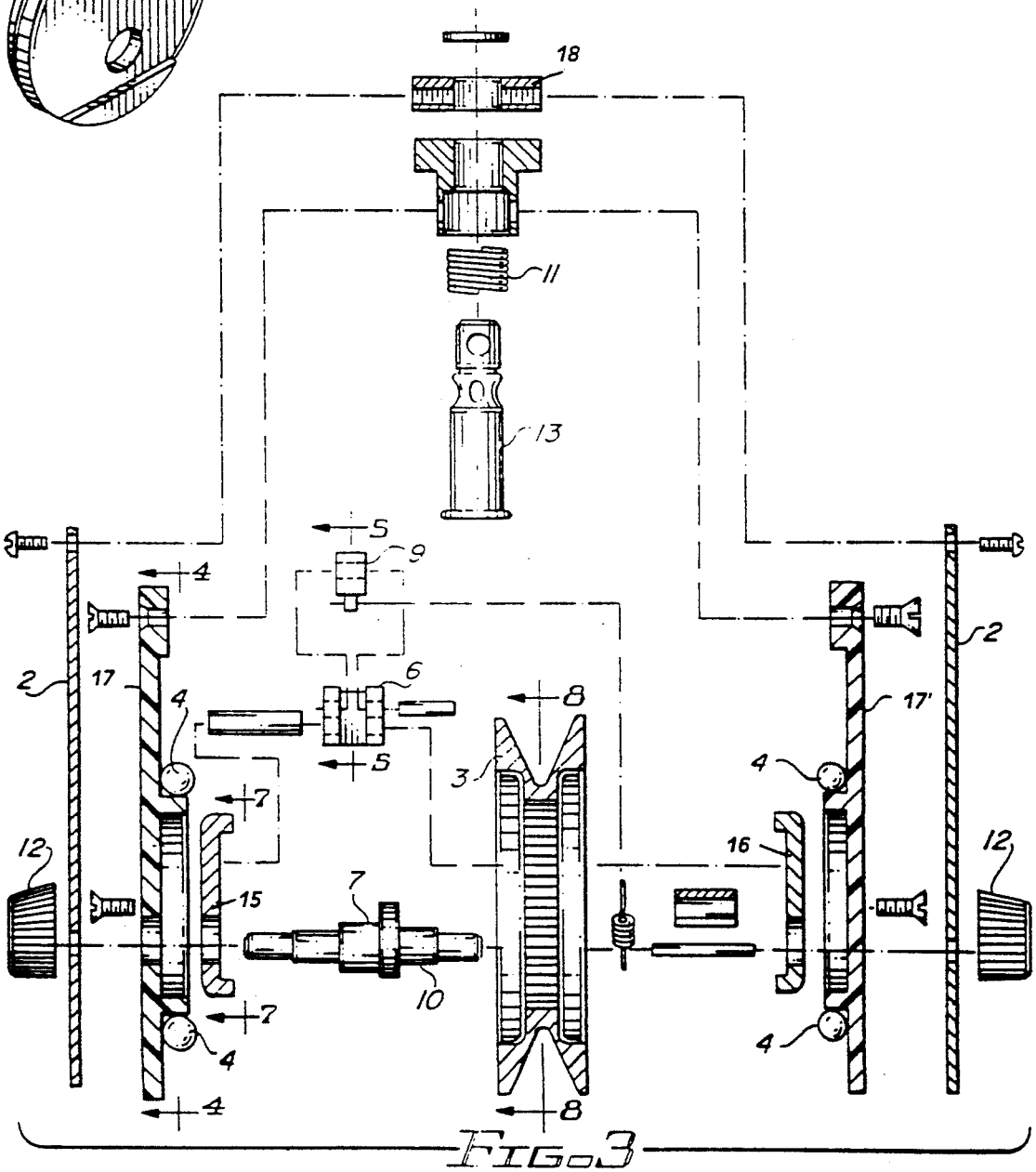
FIG. 3 is an exploded transverse vertical view of the ratchet block components.

FIG. 3 is an exploded transverse section of the ratchet block showing most of the critical components.

Figure 4:
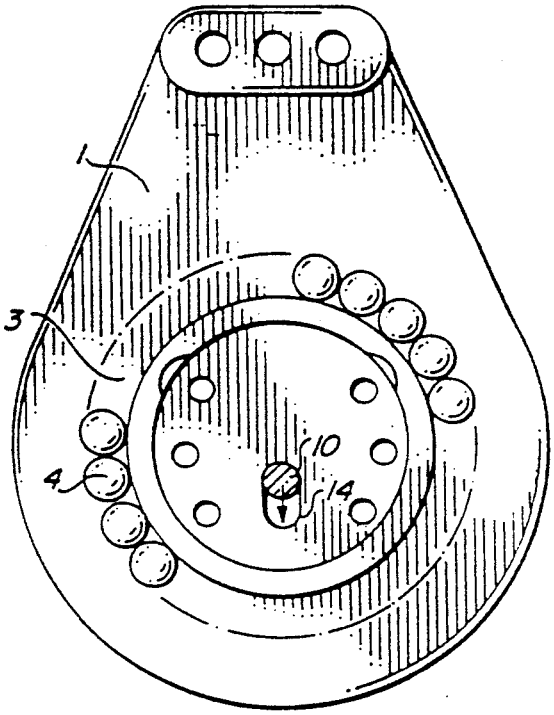
FIG. 4 is an internal side view of the sheave assembly, sheave, and ball bearings.

FIG. 4 is an internal side view of one side of the sheave assembly (1), sheave (3), and ball bearings (4). The shaft (10) can provide means for rotation of the sheave (3) in two different positions as the shaft aperture (14) is oval. When a load is placed on the sheave (3), the sheave assembly (1) moves toward the load and the sheave (3) rotates in the top part of the oval aperture (14).

Figure 5:
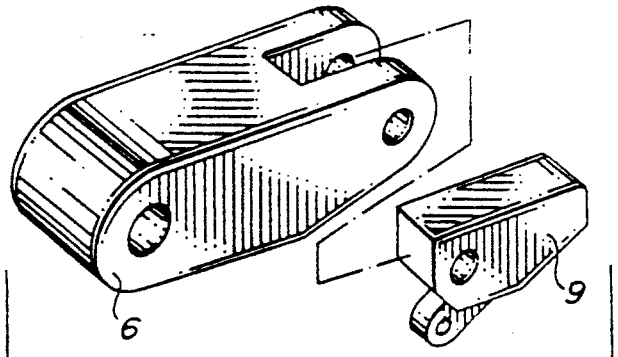
FIG. 5 is a side view of the articulated ratchet arm.
Figure 6:
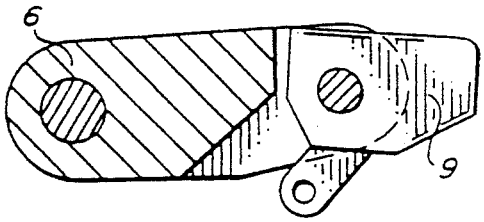
FIG. 6 shows the articulated ratchet arm with its two parts separated.
Figure 7:
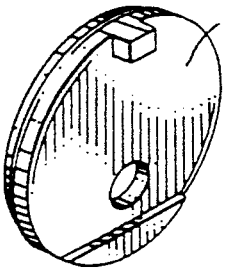
FIG. 7 shows one of two cam retaining plates of the sheave assembly.

FIGS. 5 and 6 show the articulated ratchet arm (6) assembled and separated into its two parts. The teeth engaging end (9) of the ratchet arm rotates on a small shaft to allow movement for the FIG. 7 shows cam retaining plate or disk 15. There are two such cam retaining plates 15 and 16, as seen in FIGS. 2 and 3.

Figure 8:
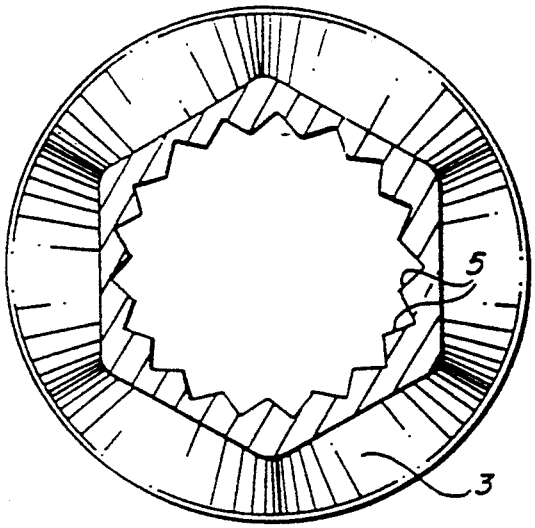
FIG. 8 is an internal side view of the teeth on the inside of the sheave.

FIG. 8 shows the sheave C3) and the teeth C5) on the inside ratcheting mode. which become engaged by the teeth engaging end {9) of the articulated ratchet arm (6).

Figure 9:
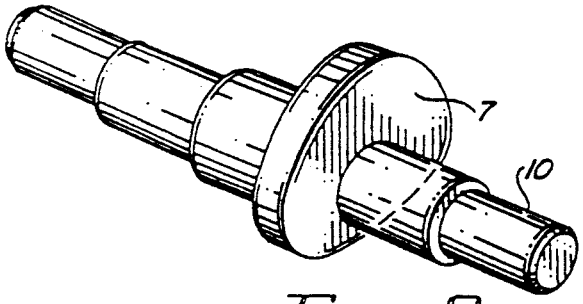
FIG. 9 shows the cam fixed to the ratchet block shaft.

FIG. 9 shows the cam (7) fixed on the shaft (10). The cam (7) has three radii to enable it to be set in three different positions per the aforementioned description of the switch {12) in FIG. 1.

Figure 10:
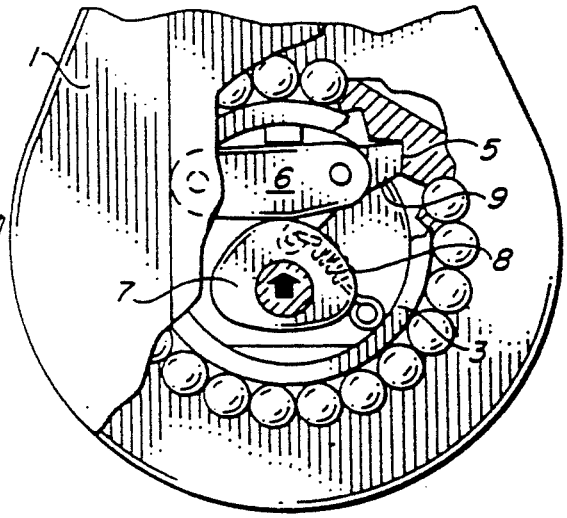
FIG. 10 is an internal side view of the ratchet assembly with cam in the automatic mode.

FIG. 10 is an internal side view of the lower part of the ratchet block and sheave assembly (1) with the cam (7) engaging the ratchet arm (6) and the teeth engaging end of the ratchet arm (9) locked between sheave teeth (5) so the sheave (3) cannot rotate in the counter clockwise direction. The ratchet spring (8) serves two functions, holding the larger part of the articulated ratchet arm (6) against the cam (7), and permitting the teeth engaging end (9) to move in the direction of rotation when the sheave (3) rotates in a clockwise direction, and to spring back (ratcheting) in between the teeth (5) when clockwise rotation stops. The cam (7) is in the automatic mode which allows engagement of the ratchet arm (6) only when the sheave assembly (1) is under load.

Figure 11:
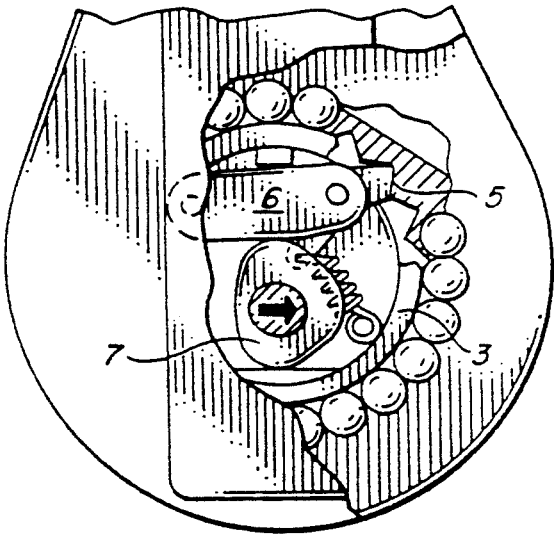
FIG. 11 is an internal side view of the ratchet assembly with cam in the on mode.

FIG. 11 is an internal side view similar to FIG. 10 except that the cam (7) is in the on position, forcing the ratchet arm (6) to engage the sheave teeth (5) whether or not there is a load placed on the sheave (4).

Figure 12:
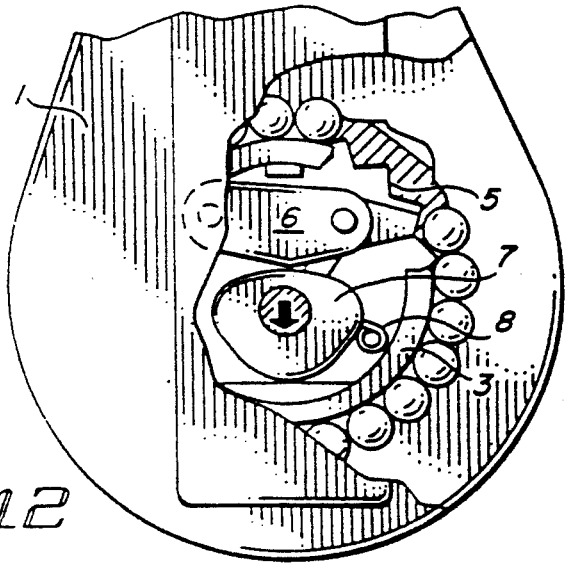
FIG. 12 is an internal side view of the ratchet assembly with cam in the off mode.

FIG. 12 is an internal side view similar to FIGS. 10 and 11 except that the cam (7) is in the off position, enabling the ratchet arm (6) to be pulled far enough away from the sheave teeth (5) by the ratchet spring (8) so that ratcheting will not occur whether or not there is a load on the sheave (3).

What is claimed is:

1. A ratchet bock assembly including:

a frame with two walls joined at an end, and a fixed shaft running between said two walls, a sheave assembly mounted within said frame and including two side plates and a sheave, said sheave being mounted on said fixed shaft for rotation thereabout and for movement toward and away from said end, said sheave having teeth around the interior thereof, said sheave assembly being spring-pressed towards said end, a ratchet assembly including a cam and a ratchet arm, said cam being mounted on said shaft, said cam being operatively associated with said ratchet arm when said sheave assembly is moved away from said end and not being operatively associated with said ratchet arm when said sheave is moved toward said end, and said ratchet arm being positioned to engage said teeth when said cam is operatively associated with said ratchet arm, whereby force on said sheave pressing said sheave against said cam causes said teeth to interengage with said teeth, preventing rotation of said sheave in one direction.

2. A ratchet block assembly according to claim 1 including an oval aperture in said sheave, positioned where said sheave fits about said shaft, said oval aperture permitting said sheave to more toward and away from said end.

3. A ratchet block assembly according to claim 1 including a spring affixed between said ratchet assembly and said ratchet arm, said spring being so positioned as to cause said ratchet arm to be spring pressed toward said cam.

4. A ratchet block assembly according to claim 4 including means to disengage said sheave assembly from said ratchet assembly, said means being a spring affixed between said frame and said sheave assembly.

5. A ratchet block assebmly according to claim 1 wherein said cam is oblong in shape such that said cam includes at least three different radii, thereby permitting at least three different positions for said ratchet arm relative to the teeth on said sheave.

6. A ratchet block assembly according to claim 3 wherein said ratchet arm is an articulated ratchet arm in two parts, one said part maintaining contact with said cam and the other said part having means to engage said teeth in said sheave, said spring being attached to said part which engages said teeth.

7. A ratchet block assembly according to claim 1 wherein said teeth have their surface radiused to said teeth engaging end of said ratchet arm.

8. A ratchet block assembly including a frame having two walls and an end a shaft running between said two walls, a sheave rotatably mounted on said shaft and adapted for movement alternately toward and away from said end, said sheave having inwardly facing teeth, a ratchet assembly including a cam mounted on said shaft, a ratchet arm in said sheave and positioned for interaction with aid teeth and said cam, said interaction occurring when said sheave is moved away from said end, whereby force on said sheave directing it for movement away from said end cases said teeth to interengage with said ratchet arm.

9. A ratchet block assembly as set forth in claim 8 including spring means associated with said end pressing said sheave toward said end and away from said cam.

* * * * *